US007396082B2

(12) United States Patent
Sanchez

(10) Patent No.: US 7,396,082 B2
(45) Date of Patent: Jul. 8, 2008

(54) TASK CHAIR

(75) Inventor: Gary L. Sanchez, Albuquerque, NM (US)

(73) Assignee: Garrex LLC, Albuquerque, NM (US)

( * ) Notice: Subject to any disclaimer, the term of this patent is extended or adjusted under 35 U.S.C. 154(b) by 148 days.

(21) Appl. No.: 11/032,594

(22) Filed: Jan. 10, 2005

(65) Prior Publication Data

US 2005/0184570 A1 Aug. 25, 2005

Related U.S. Application Data

(63) Continuation-in-part of application No. 10/888,318, filed on Jul. 9, 2004, now abandoned, which is a continuation-in-part of application No. 10/401,481, filed on Mar. 28, 2003, now Pat. No. 7,040,703.

(60) Provisional application No. 60/528,427, filed on Dec. 9, 2003, provisional application No. 60/485,775, filed on Jul. 9, 2003, provisional application No. 60/368,157, filed on Mar. 29, 2002.

(51) Int. Cl.
*A47C 7/46* (2006.01)

(52) U.S. Cl. ..... 297/353; 297/284.4

(58) Field of Classification Search ..... 297/284.1, 297/284.4, 300.8, 302.5, 302.7, 353, 354.1, 297/354.12, 452.26, 452.29
See application file for complete search history.

(56) References Cited

U.S. PATENT DOCUMENTS

| | | | |
|---|---|---|---|
| 567,096 | A | 9/1896 | Harvey et al. |
| 1,007,985 | A | 11/1911 | Smith |
| 1,414,637 | A | 5/1922 | Gell |
| 2,060,298 | A | 11/1936 | Gailey |
| 2,182,598 | A | 12/1939 | Owler |
| 2,304,349 | A | 12/1942 | Fox |
| 2,712,346 | A | 7/1955 | Sprinkle |
| 2,859,797 | A | 11/1958 | Mitchelson |
| 2,859,801 | A | 11/1958 | Moore |
| 3,015,148 | A | 1/1962 | Haddad |
| 3,041,109 | A | 6/1962 | Eames et al. |
| 3,059,971 | A | 10/1962 | Becker |
| 3,072,436 | A | 1/1963 | Moore |
| 3,107,991 | A | 10/1963 | Taussig |
| 3,112,987 | A | 12/1963 | Griffiths et al. |
| 3,115,678 | A | 12/1963 | Keen et al. |
| 3,124,092 | A | 3/1964 | Raynes |
| 3,124,328 | A | 3/1964 | Kortsch |
| 3,165,359 | A | 1/1965 | Ashkouti |
| 3,208,085 | A | 9/1965 | Grimshaw |
| 3,214,314 | A | 10/1965 | Rowbottam |
| 3,248,147 | A | 4/1966 | Testa |
| 3,273,877 | A | 9/1966 | Geller et al. |
| 3,298,743 | A | 1/1967 | Albinson et al. |
| 3,301,931 | A | 1/1967 | Morin |
| 3,314,721 | A | 4/1967 | Smith |
| 3,333,811 | A | 8/1967 | Matthews |
| 3,337,267 | A | 8/1967 | Rogers, Jr. |

(Continued)

*Primary Examiner*—Peter R. Brown
(74) *Attorney, Agent, or Firm*—Deborah A. Peacock; Peacock Myers, P.C.; Vidal A. Oaxaca

(57) ABSTRACT

The present invention relates to task chairs that support the body of the user in healthy positions while the user performs various tasks over extended sitting periods and that provide independent and independently adjustable support to the lower and the upper back.

23 Claims, 7 Drawing Sheets

U.S. PATENT DOCUMENTS

| | | | |
|---|---|---|---|
| 3,399,926 | A | 9/1968 | Hehn |
| 3,431,022 | A | 3/1969 | Poppe et al. |
| 3,434,181 | A | 3/1969 | Benzies |
| 3,436,048 | A | 4/1969 | Greer |
| 3,534,129 | A | 10/1970 | Bartel |
| 3,544,163 | A | 12/1970 | Krein |
| 3,589,967 | A | 6/1971 | Shirakawa |
| 3,601,446 | A | 8/1971 | Persson |
| 3,624,814 | A | 11/1971 | Borichevsky |
| 3,640,576 | A | 2/1972 | Morrison et al. |
| 3,758,356 | A | 9/1973 | Hardy |
| 3,807,147 | A | 4/1974 | Schoonen |
| 3,817,806 | A | 6/1974 | Anderson et al. |
| 3,844,612 | A | 10/1974 | Borggren et al. |
| 3,864,265 | A | 2/1975 | Markley |
| 3,880,463 | A | 4/1975 | Shephard et al. |
| 3,902,536 | A | 9/1975 | Schmidt |
| 3,915,775 | A | 10/1975 | Davis |
| 3,932,252 | A | 1/1976 | Woods |
| 3,947,068 | A | 3/1976 | Buhk |
| 3,961,001 | A | 6/1976 | Bethe |
| 3,965,944 | A | 6/1976 | Goff, Jr. et al. |
| 3,999,802 | A | 12/1976 | Powers |
| 4,008,029 | A | 2/1977 | Shokite |
| 4,010,980 | A | 3/1977 | Dubinsky |
| 4,013,257 | A | 3/1977 | Paquette |
| 4,018,479 | A | 4/1977 | Ball |
| 4,019,776 | A | 4/1977 | Takamatsu |
| 4,036,524 | A | 7/1977 | Takamatsu |
| 4,046,611 | A | 9/1977 | Sanson |
| 4,047,756 | A | 9/1977 | Ney |
| 4,062,590 | A | 12/1977 | Polsky et al. |
| 4,067,249 | A | 1/1978 | Deucher |
| 4,087,224 | A | 5/1978 | Moser |
| 4,107,371 | A | 8/1978 | Dean |
| 4,108,416 | A | 8/1978 | Nagase et al. |
| 4,113,627 | A | 9/1978 | Leason |
| 4,116,736 | A | 9/1978 | Sanson et al. |
| 4,125,490 | A | 11/1978 | Hettinga |
| 4,149,919 | A | 4/1979 | Lea et al. |
| 4,152,023 | A | 5/1979 | Buhk |
| 4,161,504 | A | 7/1979 | Baldini |
| 4,174,245 | A | 11/1979 | Martineau |
| 4,189,880 | A | 2/1980 | Ballin |
| 4,190,286 | A | 2/1980 | Bentley |
| 4,299,645 | A | 11/1981 | Newsom |
| 4,302,048 | A | 11/1981 | Yount |
| 4,314,728 | A | 2/1982 | Faiks |
| 4,336,220 | A | 6/1982 | Takahashi |
| 4,339,488 | A | 7/1982 | Brokmann |
| 4,364,887 | A | 12/1982 | Becht et al. |
| 4,373,692 | A | 2/1983 | Knoblauch et al. |
| 4,375,301 | A | 3/1983 | Pergler et al. |
| 4,380,352 | A | 4/1983 | Diffrient |
| 4,390,206 | A | 6/1983 | Faiks et al. |
| 4,411,469 | A | 10/1983 | Drabert et al. |
| 4,429,917 | A | 2/1984 | Diffrient |
| 4,438,898 | A | 3/1984 | Knoblauch et al. |
| 4,465,435 | A | 8/1984 | Copas |
| 4,469,738 | A | 9/1984 | Himelreich, Jr. |
| 4,469,739 | A | 9/1984 | Gretzinger et al. |
| 4,494,795 | A | 1/1985 | Roossien et al. |
| 4,502,729 | A | 3/1985 | Locher |
| 4,522,444 | A | 6/1985 | Pollock |
| 4,529,247 | A | 7/1985 | Stumpf et al. |
| 4,545,614 | A | 10/1985 | Abu-Isa et al. |
| 4,548,441 | A | 10/1985 | Ogg |
| 4,568,455 | A | 2/1986 | Huber et al. |
| 4,575,150 | A | 3/1986 | Smith |
| 4,595,237 | A | 6/1986 | Nelsen |
| 4,601,516 | A | 7/1986 | Klein |
| 4,611,851 | A | 9/1986 | Noyes et al. |
| 4,629,249 | A | 12/1986 | Yamaguchi |
| 4,629,525 | A | 12/1986 | Rasmussen |
| 4,634,178 | A | 1/1987 | Carney |
| 4,638,679 | A | 1/1987 | Tannenlaufer |
| 4,640,547 | A | 2/1987 | Fromme |
| 4,643,481 | A | 2/1987 | Saloff et al. |
| 4,653,806 | A | 3/1987 | Willi |
| 4,666,121 | A | 5/1987 | Choong et al. |
| 4,668,012 | A | 5/1987 | Locher |
| 4,670,072 | A | 6/1987 | Pastor et al. |
| 4,691,961 | A | 9/1987 | Rogers, Jr. et al. |
| 4,703,974 | A | 11/1987 | Braeuning |
| 4,709,443 | A | 12/1987 | Bigley |
| 4,709,962 | A | 12/1987 | Steinmann |
| 4,720,142 | A | 1/1988 | Holdredge et al. |
| 4,743,323 | A | 5/1988 | Hettinga |
| 4,761,033 | A | 8/1988 | Lanuzzi et al. |
| 4,763,950 | A | 8/1988 | Tobler |
| 4,776,633 | A | 10/1988 | Knoblock et al. |
| 4,779,925 | A | 10/1988 | Heinzel |
| 4,793,197 | A | 12/1988 | Petrovsky |
| 4,796,950 | A | 1/1989 | Mrotz, III et al. |
| 4,796,955 | A | 1/1989 | Williams |
| 4,803,118 | A | 2/1989 | Sogi et al. |
| 4,815,499 | A | 3/1989 | Johnson |
| 4,815,789 | A | 3/1989 | Marcus |
| 4,819,458 | A | 4/1989 | Kavesh et al. |
| 4,826,249 | A | 5/1989 | Bradbury |
| 4,829,644 | A | 5/1989 | Kondo et al. |
| 4,830,697 | A | 5/1989 | Aizawa |
| 4,831,697 | A | 5/1989 | Urai |
| 4,842,257 | A | 6/1989 | Abu-Isa et al. |
| 4,846,230 | A | 7/1989 | Mock et al. |
| 4,852,228 | A | 8/1989 | Zeilinger |
| 4,860,415 | A | 8/1989 | Witzke |
| 4,861,106 | A | 8/1989 | Sondergeld |
| 4,869,554 | A | 9/1989 | Abu-Isa et al. |
| 4,885,827 | A | 12/1989 | Williams |
| 4,889,384 | A | 12/1989 | Sulzer |
| 4,889,385 | A | 12/1989 | Chadwick et al. |
| 4,892,254 | A | 1/1990 | Schneider et al. |
| 4,902,069 | A | 2/1990 | Lehnert |
| 4,904,430 | A | 2/1990 | Yamada |
| 4,906,045 | A | 3/1990 | Hofman |
| 4,927,698 | A | 5/1990 | Jaco et al. |
| 4,939,183 | A | 7/1990 | Abu-Isa et al. |
| 4,942,006 | A | 7/1990 | Loren |
| 4,943,115 | A | 7/1990 | Stucki |
| 4,946,224 | A | 8/1990 | Leib |
| 4,961,610 | A | 10/1990 | Reeder et al. |
| 4,966,411 | A | 10/1990 | Katagiri et al. |
| 4,968,366 | A | 11/1990 | Hukki et al. |
| 4,979,778 | A | 12/1990 | Shields |
| 4,981,325 | A | 1/1991 | Zacharkow |
| 4,981,326 | A | 1/1991 | Heidmann |
| 4,986,948 | A | 1/1991 | Komiya et al. |
| 4,988,145 | A | 1/1991 | Engel |
| 5,000,515 | A | 3/1991 | Deview |
| 5,009,827 | A | 4/1991 | Abu-Isa et al. |
| 5,009,955 | A | 4/1991 | Abu-Isa |
| 5,013,089 | A | 5/1991 | Abu-Isa et al. |
| 5,015,034 | A | 5/1991 | Kindig et al. |
| 5,029,940 | A | 7/1991 | Golynsky et al. |
| 5,033,791 | A | 7/1991 | Locher |
| 5,070,915 | A | 12/1991 | Kalin |
| 5,071,189 | A | 12/1991 | Kratz |
| 5,096,652 | A | 3/1992 | Uchiyama et al. |
| 5,100,713 | A | 3/1992 | Homma et al. |
| 5,106,678 | A | 4/1992 | Abu-Isa |
| 5,107,720 | A | 4/1992 | Hatfield |
| 5,114,211 | A | 5/1992 | Desanta |
| 5,116,556 | A | 5/1992 | Danton |

5,117,865 A 6/1992 Lee
5,135,694 A 8/1992 Akahane et al.
5,143,422 A 9/1992 Althofer et al.
5,153,049 A 10/1992 Groshens
5,228,747 A 7/1993 Greene
5,240,308 A 8/1993 Goldstein et al.
5,288,130 A 2/1994 Foster
5,288,135 A 2/1994 Forcier et al.
5,407,248 A 4/1995 Jay et al.
5,501,507 A 3/1996 Hummitzsch
5,547,251 A 8/1996 Axelson
5,678,891 A 10/1997 O'Neill et al.
5,679,891 A 10/1997 Matsuno et al.
5,704,689 A 1/1998 Kim
6,079,782 A 6/2000 Berg et al.
6,089,664 A 7/2000 Yoshida
6,095,611 A 8/2000 Bar et al.
6,152,532 A 11/2000 Cosentino
6,189,971 B1 2/2001 Witzig
6,193,313 B1 2/2001 Jonsson
6,254,186 B1 7/2001 Falzon
6,334,650 B1 1/2002 Chien-Chuan
6,334,651 B1 1/2002 Duan et al.
6,338,530 B1 1/2002 Gowing
6,352,307 B1 3/2002 Engman
6,386,634 B1 5/2002 Stumpf et al.
6,431,648 B1 8/2002 Cosentino et al.
6,447,061 B1 9/2002 Klingler
6,478,379 B1 11/2002 Ambasz
6,499,802 B2 12/2002 Drira

TASK CHAIR

CROSS-REFERENCES TO RELATED APPLICATIONS

This application is a continuation-in-part application of, and claims priority to: U.S. patent application Ser. No. 10/401,481, entitled "The Health Chair A Dynamically Balanced Task Chair", filed Mar. 28, 2003, which claims the benefit of the filing of U.S. Provisional Patent Application Ser. No. 60/368,157; and U.S. patent application Ser. No. 10/888,318, entitled "Task Chair", filed Jul. 9, 2004, which claims the benefit of the filing of U.S. Provisional Patent Application Ser. No. 60/485,775, entitled "Task Chair", filed Jul. 9, 2003 and U.S. Provisional Patent Application Ser. No. 60/528,427, entitled "Task Chair", filed Dec. 9, 2003; and PCT Application Serial No. US/04/21761, filed Jul. 9, 2004. The claims and specifications of these applications are incorporated herein by reference.

BACKGROUND OF THE INVENTION

1. Field of the Invention (Technical Field)

The present invention relates to task chairs that support the body of the user in healthy positions while the user performs various tasks over extended sitting periods and that provide independent and independently adjustable support to the lower and the upper back.

2. Description of Related Art

Note that the following discussion refers to a number of publications by author(s) and year of publication, and that due to recent publication dates certain publications are not to be considered as prior art vis-a-vis the present invention. Discussion of such publications herein is given for more complete background and is not to be construed as an admission that such publications are prior art for patentability determination purposes.

Today, the average worker performs less physical activity and workers perform increasingly more of their work while in a seated position. It is known that if any part of person's anatomical function is impinged or static (i.e., remaining in a fixed position) for extended periods of time, posture and health are compromised. It has been determined that both physically active and physically inactive people suffer health problems caused by prolonged sitting. Those problems include lower back pain, muscle tension, numbness, acid reflux, carpel tunnel syndrome, and general fatigue.

Peter Escogue, a recognized expert in anatomical function, suggests these problems are posture related as well as inactivity related. Proper anatomical posture promotes proper anatomical function, i.e. the body functions best when operated from a proper position. Escogue further observes that over a period of time, many persons compromise correct posture causing problems in correct anatomical function.

Static, improper posture (e.g., while sitting in a static improper supporting chair) causes poor leads to poor health. In the prior art, seats and chairs have been designed for comfort and for performing tasks. Task chairs were designed to incorporate pads, tilts, swivels, etc. Over time, health improvements were added to the combination of such items as family room recliners and workers' rigid elevating stools. Additions such as lumbar supports, adjustable armrests, seat backs with shapes designed for a general vertebrae contour, etc., were incorporated. However, today's combination task chairs offer few features to accommodate multiple tasks while simultaneously giving adequate consideration to seating health.

Task chairs are typically configured to allow tilting of the seat and backrest as a unit or tilting of the backrest relative to the seat. In chairs having a backrest pivotally attached to a seat in a conventional manner, the movement of the backrest relative to the seat can create shear forces acting on the legs and back of the user. These shear forces tend to cause an uncomfortable pulling of the user's clothing. In an attempt to compensate for these shear forces, some office chairs include a backrest which pivots while the seat tilts, such as those disclosed in U.S. Pat. No. 2,859,801 (to Moore) and U.S. Pat. No. 4,429,917 (to Diffrient).

A related disadvantage of conventional task chairs is the configuration of the seat and/or backrest. Such seats typically include single or multi-density foam padding with a covering such as cloth, leather, mesh material or the like, such seating also tends to provide insufficient aeration since it acts as another layer of clothing and does not contain a Spinal Relief Channel in the back support, and/or contain a Coccyx Relief in the horizontal seat. In addition, the structural requirements of such an attachment limits the shape and size of the frame and the membrane.

Typically, the seats of office task chairs are supported by a single stage telescoping column which provides for vertical adjustment of the seat. These columns include a gas spring mounted in a telescoping tube which is slidable within a base tube. In accordance with guidelines set by the American National Standards Institute (A.N.S.I.) and Business and Institutional Furniture Manufacturer's Association (B.I.F.M.A.), conventional office chairs in the United States are typically adjustable from a seat height of 16.0 inches from a floor to about 20.5 inches from a floor. Nevertheless, it is desirable to exceed this range of height adjustment to account for very small or large users and to accommodate the international population in general.

Typically, it is difficult to exceed this range of height adjustment with seats which tilt about the knees or ankles of the user. To offset the moments acting on single stage support columns, pneumatic manufacturers typically set a minimum overlapping distance of 2.95 inches (75 mm) between the tubes. Because such "ankle tilt" and "knee tilt" chairs have relatively large tilt housings, it is difficult to provide a lower minimum and higher maximum seat height while maintaining the required overlapping distance between the tubes. These types of tilting chairs also impart a greater moment on the tube since the pivot axis is offset from the support column. It is therefore desirable to provide a vertically adjustable support column having a greater overlapping distance to permit a greater stroke which decreases the minimum height and increases the maximum height of a chair seat.

Devices that incorporate a plurality of adjustable means have been disclosed in the prior art such as, for example, U.S. Pat. No. 6,478,379 (to Ambasz) and U.S. Pat. No. 6,189,971 (to Witzig). However, those devices do not allow for the independent adjustment of multiple, vertical backrest support arms.

Other devices disclose the use of various seat and back units incorporating means for altering the contour of the pads used on such seats such as, for example, U.S. Pat. No. 6,499,802 (to Drira) and U.S. Pat. No. 6,447,061 (to Klingler). However, these devices do not allow for the independent adjustment of multiple, vertical backrest support arms.

Although offering varying shapes, contours, masses and sizes, as well as a wide range of adjustment means. i.e. pivotal, tilt, height, in/out, up/down, soft/firm, etc., all attempts at healthy task chairs in the prior art are burdened with an interdependent posterior design support which ultimately restricts and compromises adjustability, dynamic support, and active seating. A chair that provides better posterior support and continuous animation, and better supports task functions, is needed.

BRIEF SUMMARY OF THE INVENTION

The present invention comprises an adjustable task chair comprising a seat, at least two back support members, each back support member independently supported by a vertical brace support member, at least one of the back support members being adjustable, and each brace support member supported by a frame. One of the brace support members is preferably disposed behind the other brace support member. The invention further comprises at least one holding component mounted on a posterior section of the frame and holding each brace support member in a position. The chair preferably comprises at least one adjusting component for overcoming holding of the holding component to adjust at least one of the vertical brace support members. One of the back support members preferably supports a lower back of a seated person and another of the back support members supports an upper back of the seated person. The holding component preferably comprises a spring to bias each brace support member. The adjusting components may comprise an actuator system. At least one of the adjusting components connects to at least one pneumatic gas cylinder.

The invention further comprises at least one adjusting component to independently adjust a length of at least one brace support member and/or at least one adjusting component to independently adjust at least one brace support member in a direction towards, or away from, the seat. The adjusting component may comprise a telescoping component to adjust a length of the brace support member. The adjusting components may control an angle of at least one of the brace support members. The adjusting components may further control tilt lock of at least one brace support member. Also, the adjusting components may control tilt tension of at least one brace support member.

At least one back support member comprises vertical indentations along a center of the back support member, the indentations comprising dimensions sufficient to relieve pressure on a spine of a seated person when the seated person reclines against the back support member. Each back support member may comprise a pad, the pads oriented horizontally and sufficiently spaced apart to relieve pressure on a spine of a seated person when the seated person reclines against the back support members. The seat may comprise a depression to relieve pressure of a coccyx of a seated person when the person sits on the seat.

The invention also comprises at least one adjustable arm rest. The arm rests may be tiltably adjustable, adjustable in a direction toward, and away from, a center of the chair, adjustable in height, and/or rotatably adjustable.

The chair may comprise a shroud to hold and conceal adjusting systems. The chair may comprise at least one adjusting component to adjust at least one of the back support members in a vertical direction.

The chair comprises active seating and may comprise at least one adjustment alert.

A primary object of the present invention is to provide a task chair that promotes healthier seating by supporting proper anatomical posture and proper skeletal support and that and supports multiple task functions over extended seating periods.

Another object of the present invention is to provide a task chair that provides continuous position animation and "active seating".

A primary advantage of the present invention is that it provides independent upper back support and lower back support that are easily and independently adjustable.

Another advantage of the present invention is that it provides anatomical support to the user while the user performs a wide range of tasks in a seated position.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into, and form a part of, the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention relates to task chairs that support the body of the user in healthy positions while the user performs various tasks over extended sitting periods and that provide independent and independently adjustable support to the lower and the upper back.

Figure 1:
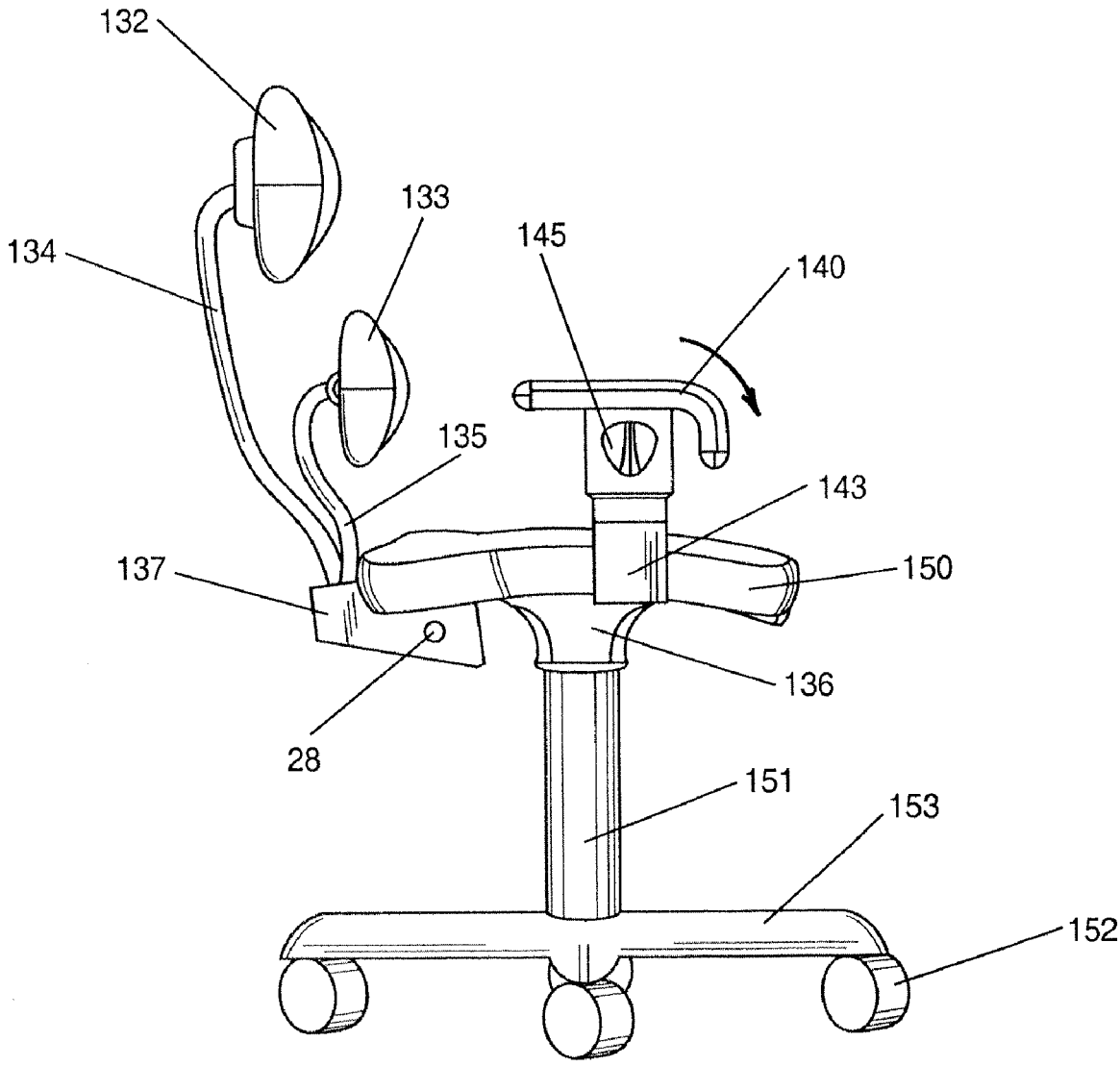
FIG. 1 is a side view of the preferred embodiment of the present invention.

Turning now to the figures, which describe the preferred embodiment of the present invention, FIG. 1 shows chair 100 with back support members 132, 133. Either, or both, of back support members 132, 133 are preferably adjustable, and preferably in a vertical direction. Adjusting components or systems (not shown) are preferably incorporated to make such adjustments. Preferably, two back support members are used, but more may be utilized in other embodiments. Back support members 132 and 133 preferably attach to vertical brace support members 134, 135, respectively, at least one of which is preferably adjustable. Brace support members 134 and 135 are preferably attached to seat frame 136 via holding component 137. Chair 100 comprises seat 150 preferably attached via seat frame 136 to telescope pedestal 151. Pedestal 151 is preferably movably supported by casters 152 preferably secured to base 153.

The height of either back support members 132, 133 may be adjusted by moving them up and down or by adjusting the length of brace support members 134, 135. The latter is the preferred embodiment.

Figure 6:
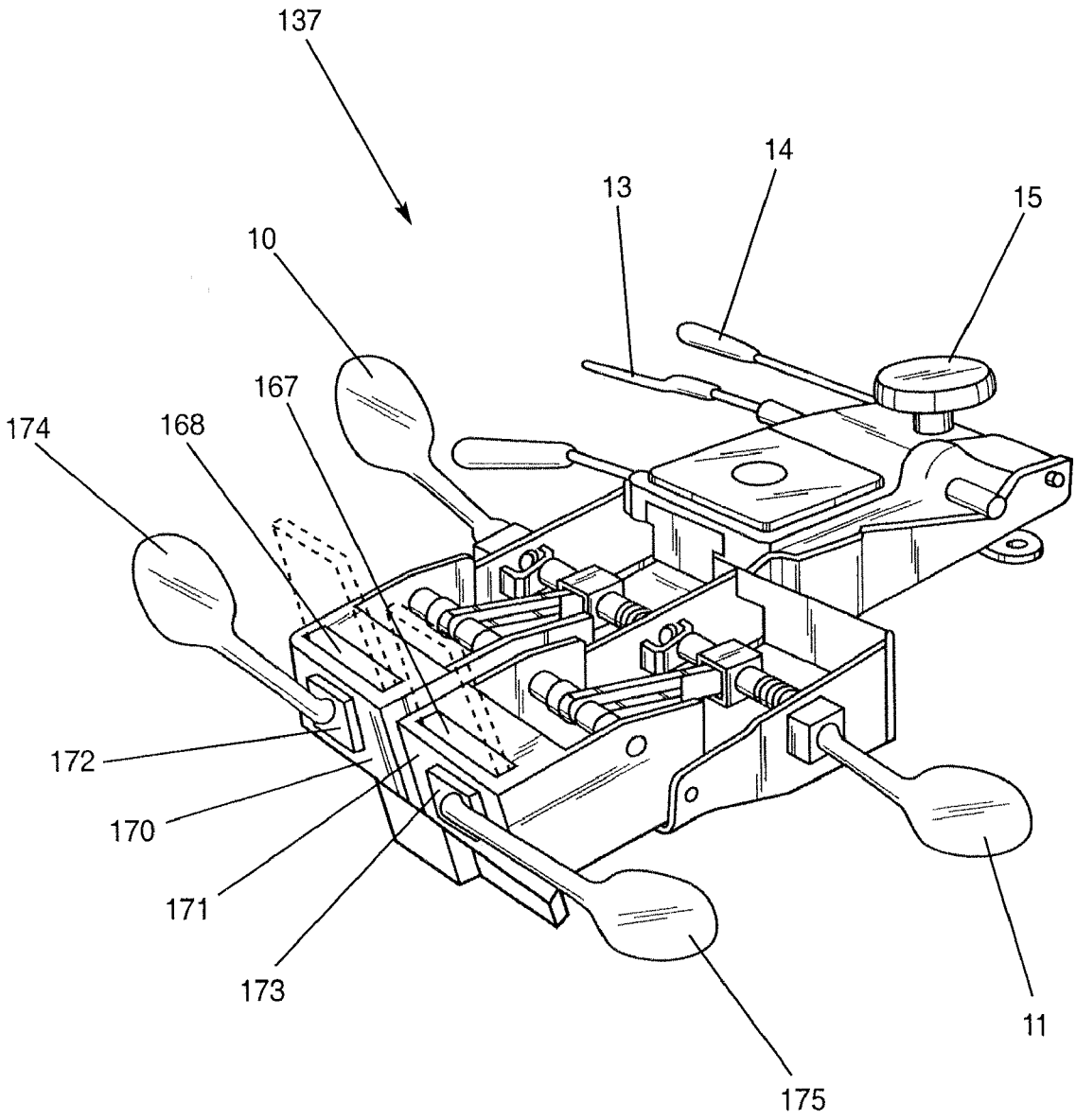
FIG. 6 is a bottom plan view of the preferred embodiment of the seat control mechanism of the present invention.

Independent brace support members 134, 135 preferably attach to holding component 137 via connectors 170, 171 (shown in FIG. 6). Connectors 170, 171 may be of any type known in the art such as, for example, spring loaded connectors if spring loaded hinges 168, 168 (shown if FIG. 6) are utilized. In the preferred embodiment, actuator buttons 26, 28 (actuator 26 shown in FIG. 4) are utilized as discussed in more detail below with respect to FIG. 4 and FIG. 7.

In the preferred embodiment, brace support member 134, which is taller than brace support member 135, is disposed directly behind brace support member 135. This positioning of brace support members 134, 135 in such an orientation results not only in a more aesthetic appearance for chair 100, but also enables a user to straddle brace support members 134, 135 while sitting in chair 100 facing backwards. Sitting in chair 100 backwards enables the user to not only gain abdominal support from adjustable back support member 133, but also to gain upper chest support from adjustable back support member 132. Such support is often needed by users who engage in activities that require a substantial amount of time looking downward. For example dentists, jewelers, dental lab technicians, and computer wafer manufacturers would all benefit from anterior support.

In another embodiment of the present invention, an apparatus (not shown) for indicating the height of adjustable back support members 132, 133 can be provided. These would enable each user to quickly return the height of adjustable back support members 132, 133 to his or her desired setting. Numerous apparatuses known in the art can be utilized to achieve this objective. For example, such apparatus may comprise one or more dials with an indicator (not shown) which point to a series of numbers (i.e. an apparatus similar to a volume knob). The apparatus can also be incorporated by disposing a window (not shown) at the back of holding component 137, wherein one or more scales (not shown) are displayed and affixed to each of brace support members 134, 135. Therefore, when brace support members 134, 135 are moved, the scale would slide, thus showing a different numbered setting.

Figure 2:
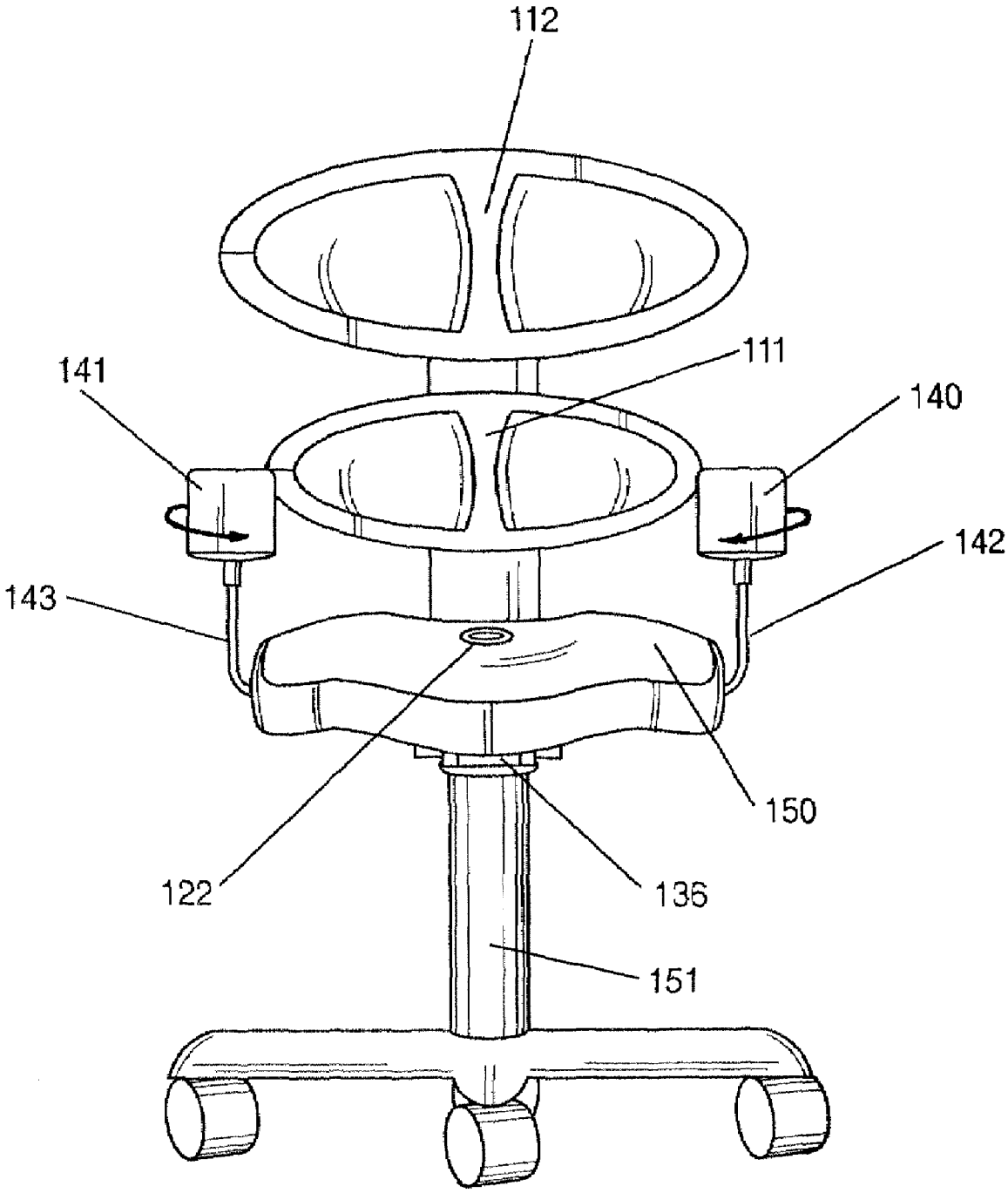
FIG. 2 is a front view of the preferred embodiment.

FIGS. 1 and 2 show two adjustable forearm support members 140, 141 secured to seat 150 via forearm attachment members 142, 143 which are provided with forearm support adjustors 144, 145. Any means known in the art may be utilized to accomplish the adjustment of the height of forearm support members 140, 141 such as, for example, using telescoping means to adjust the length of forearm attachment members 142, 143.

In the preferred embodiment, when the user requires elbow and lower arm support, whether anterior or posterior, forearm support members 140, 141 comprise adjustment flexibility to accommodate adjustments to the "tilt arm rest" from up to down, inwardly and outwardly, and to tilt downwardly from the posterior to anterior allowing an angled support. Such capability is useful for such tasks as typing as it has been suggested that a proper, healthy typing position involves a relaxed upper arm and shoulder support at the elbow, while simultaneously allowing lower arm, wrist, and hand to be in straight alignment angled downwardly from the elbow. This typing posture helps prevent carpel tunnel syndrome. Forearm support members are adjustable along all planes, including tilt, rotation, and in a direction toward and away from the center of chair 100.

Chair 100 provides flexibility through adaptability. For example, when the user requires anterior (forward) support, the seating can be reversed (i.e., the user can sit backwards) to accommodate forward tasks. As noted above, should the user require elbow and lower arm support, adjustable forearm support members 140, 141 are adjustable to support vertical and lateral task movements.

In the preferred embodiment, as shown in FIG. 2, adjustable back support members 131, 132 comprise vertical indentations 111, 112 (i.e., spinal relief channels) to relieve pressure that is applied against the spinal column of a user when the user reclines against back support members 131, 132. Indentations 111, 112 may be of any size sufficient to relieve pressure to the spine of a user. In another embodiment, back support members 131, 132 can each comprise two pads (not shown) connectedly spaced apart so that the space between them accommodates the immediate area of the spine to relieve pressure or remove pressure to the spine.

Figure 3:
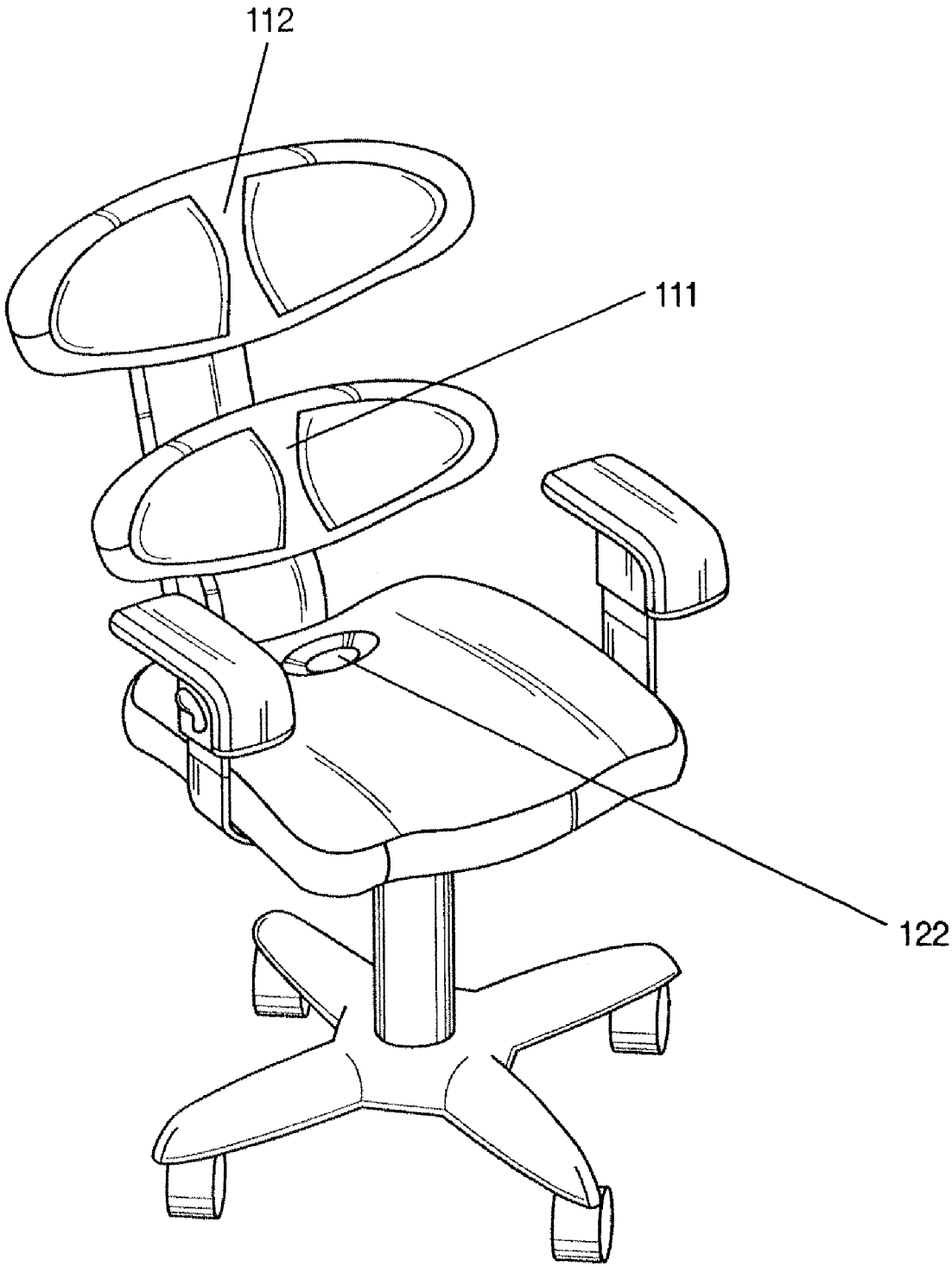
FIG. 3 is a perspective front view of the preferred embodiment.

FIGS. 2 and 3 show seat member 150 comprising indentation 122 to relieve pressure to the coccyx of a user that results when the user sits on seat member 150. Indentation 122 may be of any size and shape including, but not limited to, rectangles or squares.

Figure 4:
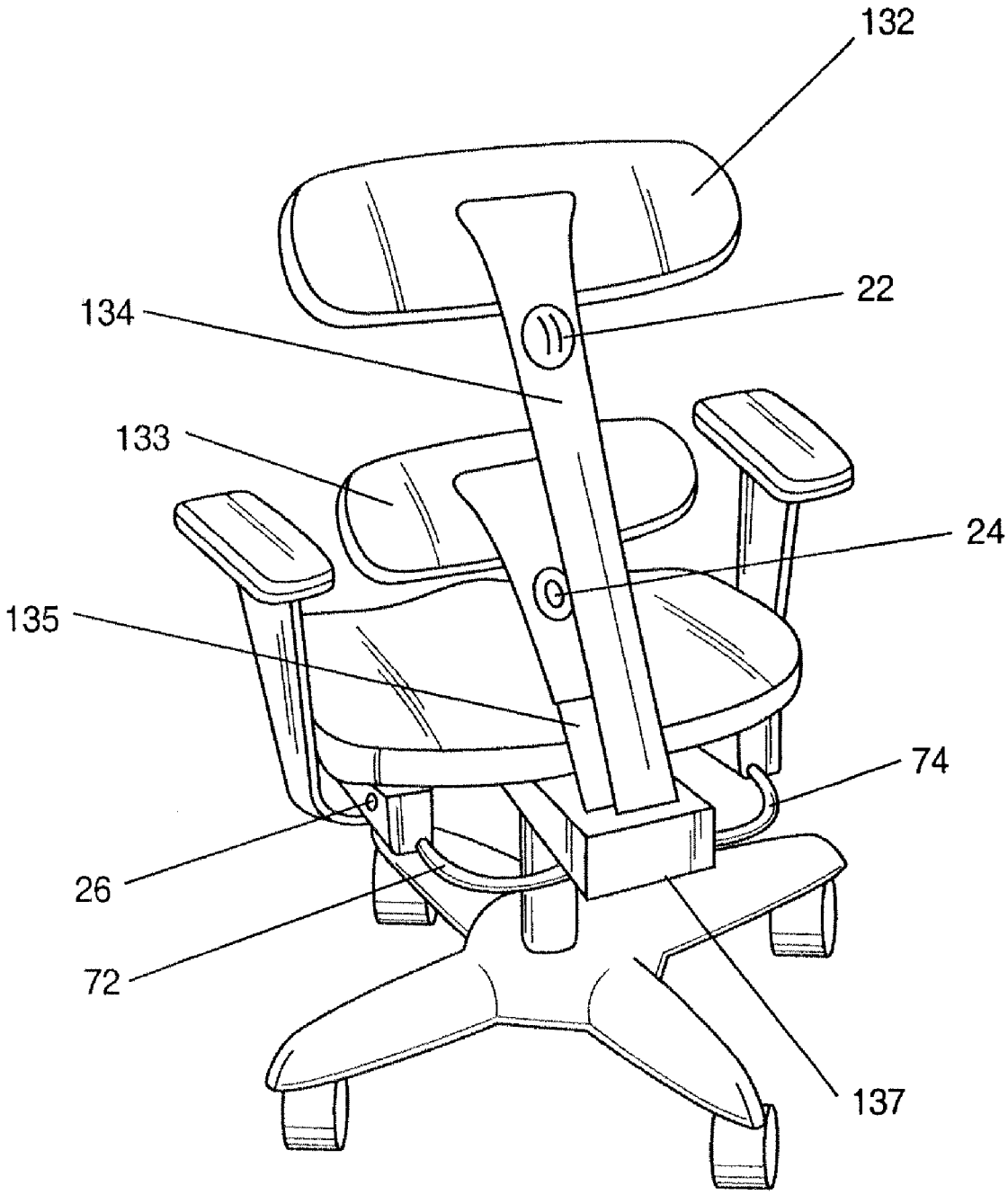
FIG. 4 is a perspective rear view of the preferred embodiment.

FIG. 4 shows another view of the preferred embodiment of the invention. Brace support members 134, 135 incorporate adjustors 22, 24 to adjust the length of brace support members 134, 135 so as to adjust the height of brace support members 134, 135. Any means known in the art for increasing or reducing the length of brace support members 134, 135 may be utilized. Preferably, a telescoping means as shown in FIG. 4 is utilized.

Also shown in FIG. 4 is actuator button 26 and actuator cable 72 which are used to adjust either brace support member 134 or 135. Similarly actuator 28 (shown in FIG. 1) and actuator cable 74 control the other of either brace support member 134 or 135.

Figure 5:
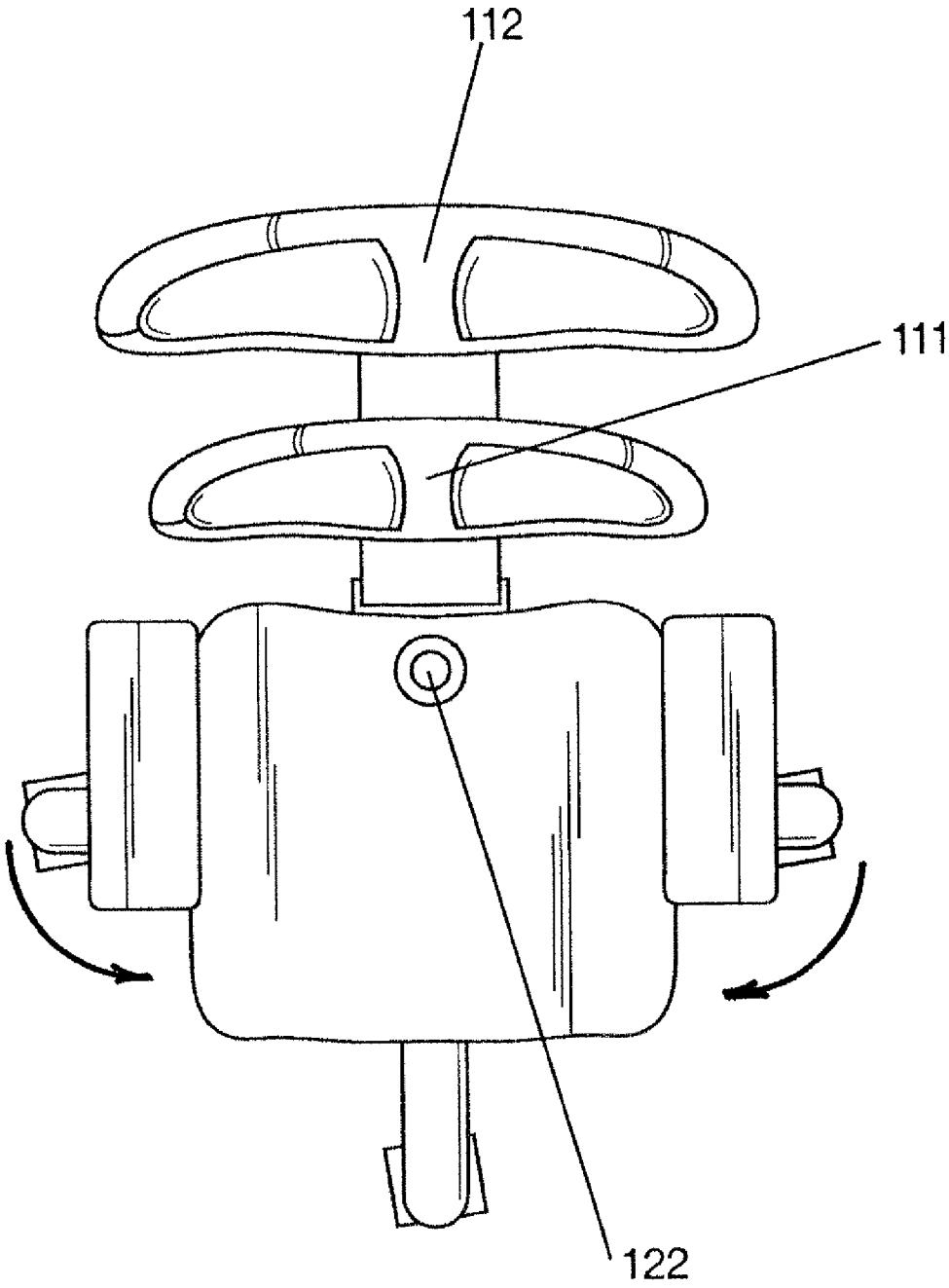
FIG. 5 is a top view of the preferred embodiment.

FIG. 5 shows a top view of the preferred embodiment with indentations 111, 112, and 122 clearly visible.

FIG. 6 shows the interior of holding component 137 of another embodiment intended for the application to brace support members 134, 135 that are oriented adjacent to each other in a side-to-side manner and in which a spring loaded system is used to hold and adjust brace support members fore and aft. Depicted are hinged means 167, 168 adjustable by adjustment means 10, 11, 174, 175 that are attached to seat 137. As shown in this embodiment, chair 100 can include seat slide and lock adjustment means 13, seat tilt adjustment means, 14, and seat tension adjustment means 15 attached to holding component 137.

Figure 7:
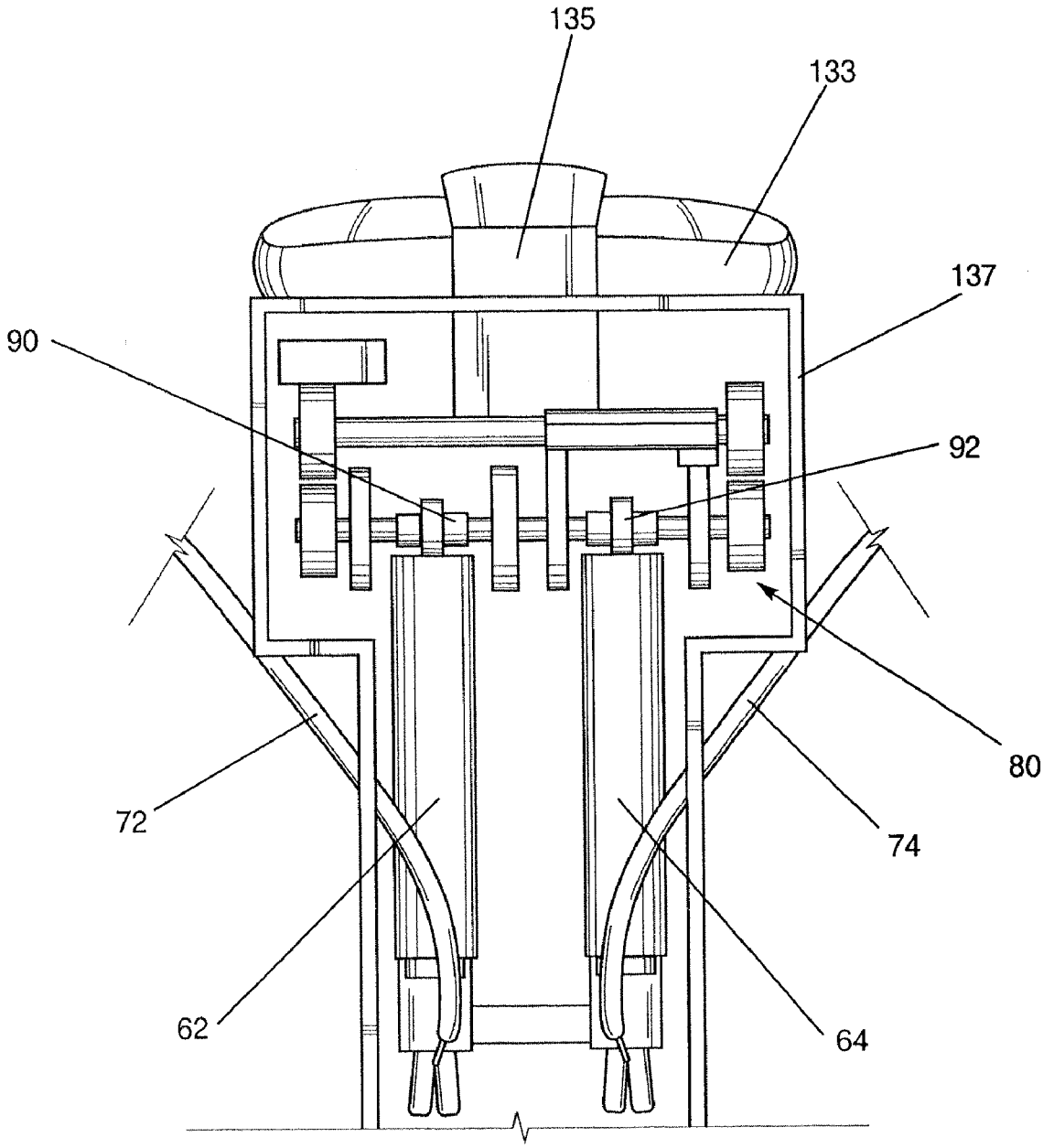
FIG. 7 is a top perspective plan view of another embodiment of the seat control mechanism of the present invention.

In the preferred embodiment, as shown in FIG. 7 (and in FIG. 4), an adjusting component which in this embodiment is actuator system 80 consists of actuator buttons 26, 28 connected to flexible actuator cables 72, 74 (alternatively, cable-like components can be used) are used to control the adjustment of brace support members 134, 135 which in turn control the adjustment of adjustable back support members 132, 133. Cables 72, 74 enable any control mechanism or adjusting component, including actuator buttons 26, 28 to be disposed in virtually any location with ease.

It should be apparent that such an actuator system can be used to control any of the various adjustable functions of chair 100. It should also be apparent that controlling the adjustability of brace support members 134, 135 may be accomplished by any means known in the art. For example, adjustments may be made with dials, slide mechanism, and the like to control the height, angle, and/or other properties of back support members 132, 133.

As shown in FIGS. 1 and 6 actuator buttons 26, 28 are preferably placed on the underside of the seat to control characteristics of chair 100, including, but not limited to, height, angle, tilt lock, and tilt tension of back support members 132, 133 and brace support members 134, 135 and the height of seat 150. Actuator buttons 26, 28 are preferably disposed on holding component 137. Component 137 preferably functions as a shroud to conceal actuator system 80 and buttons 26, 28, or a separate shroud (not shown) may conceal portions of actuator buttons 26, 28 and other parts of actuator system 80 or any other adjusting system utilized.

Actuator system 80 preferably includes pneumatic gas cylinders 62, 64 connected to cables 72 74 and to actuator linkage mechanisms 90, 92 that are linked to brace support members 134, 135.

A key to healthy, task seating is a series of adjustable support means that accommodate a wide range of individual body dimensions and preferences as well as a wide range of tasks to be accomplished in a seating position.

The "active seating" provided by the present invention allows for periodic adjustments to various seat supporting members, which allow the body's systems to remain active, uncompromised and functioning properly. Static seating is the antithesis of active seating.

To increase the benefits of the present invention and enhance "active seating", another embodiment includes the incorporation various adjustment alert means (not shown) into chair 100 to alert a user that enough time has elapsed so that making an adjustment is advisable. Thus, a user can, without having to be too engaged in the use chair 100 be assured of not remaining in a static position for too long.

Thus, the present invention provides a series of independent bracing supports anywhere along the line of vertebrae from the sacrum to the cervix. Depending on the embodiment, two or more independently adjustable bracing support arms are secured to, and arise from, the seating frame, seat support, seat pedestal, or seat. One or more brace supports attach to these arms and each brace support arm has flexible adjustments in order to accommodate individual user dimensions. This arrangement of a series of independent hinged, spring arms with adjustable brace supports allows the user to participate in a wide range of tasks with optimum and healthy muscle/skeletal support.

The ability to frequently reposition the support members described herein in order to affect periodic, slight anatomical movement of muscoloskeletal, respiratory, nervous, digestive and circulatory systems ensures that these body systems remain uncompromised and unimpinged. This periodic slight repositioning of the various support members allows muscles to relax while redistributing anatomical pressure.

All elements described herein are preferably integrated to respond in concert to a myriad of user sizes and shapes and a wide variety of chair-based tasks with a healthy muscle/skeletal support system.

EXAMPLE

A chair in accordance with the description provided herein was constructed with the following components:

1. A lumbar support pad was attached to a vertical brace support member.

2. An upper back support pad was attached to a vertical brace support member.

3. The upper back vertical brace member was disposed directly behind the lumbar pad support pad's vertical brace support member.

4. Telescoping means were used for adjusting the vertical length of each vertical support brace.

5. Actuators systems were incorporated to independently adjust each vertical support brace member.

6. The actuator system incorporated two pneumatic gas cylinders, one for each vertical support brace member.

7. Attached to each gas cylinder was an actuator cable.

8. Each cable was controlled by an actuator button, one for each vertical brace support member.

9. Adjustable arm rests were provided using telescoping means for their height adjustment.

10. The arm rests were tiltable fore and aft.

11. The arm rests were adjustable side to side so that their distance away from the body of the chair could be increased as needed.

12. The seat height was adjustable.

13. The lumbar back rest incorporated a vertical indentation for the relief of spinal pressure.

14. The upper back rest incorporated a vertical indentation for the relief of spinal pressure.

15. The seat incorporated a rearward indentation for the relief of pressure to the coccyx.

16. A base with casters was provided.

17. The seat was provided with means to swivel.

The preceding examples can be repeated with similar success by substituting the generically or specifically described reactants and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An adjustable task chair comprising:

a seat;

at least two back support members;

each said back support member independently supported by a single, tiltable, vertical brace support member, each of said back support members being adjustable;

each said brace support member supported by, and pivotally attached to, a frame;

each said brace support member adjustable, independent of each said other brace support member, adjusting a position of each said back support member in an anterior and a posterior direction to vary an angle defined by said back support member with respect to said seat;

at least one holding component mounted on a posterior section of said frame and holding each said brace support member in a position; and each said holding component comprises a spring to bias said corresponding brace support member.

2. The chair of claim 1 wherein one of said brace support members is disposed behind another of said brace support members.

3. The chair of claim 1 further comprising at least one adjusting component for overcoming holding of said holding component to adjust at least one of said vertical brace support members.

4. The chair of claim 3 wherein at least one of said adjusting components comprises an actuator system.

5. The chair of claim 3 wherein said adjusting component comprises a telescoping component to adjust a length of said brace support member.

6. The chair of claim 3 wherein said adjusting components control an angle of at least one said brace support member.

7. The chair of claim 3 wherein said adjusting components further control tilt lock of at least one said brace support member.

8. The chair of claim 1 wherein one of said back support members supports a lower back of a seated person and another of said back support members supports an upper back of the seated person.

9. The chair of claim 1 further comprising:

at least one adjusting component to independently adjust a length of at least one of said brace support members; and at least one adjusting component to independently adjust at least one of said brace support members in a direction towards, or away from, said seat.

10. The chair of claim 1 wherein at least one of said back support members comprises vertical indentations along a center of said back support member, said indentations comprising dimensions sufficient to relieve pressure on a spine of a seated person when the seated person reclines against said back support member.

11. The chair of claim 1 wherein each of said back support members comprises a pad, said pads oriented horizontally and sufficiently spaced apart to relieve pressure on a spine of a seated person when the seated person reclines against said back support members.

12. The chair of claim 1 wherein said seat comprises a depression to relieve pressure of a coccyx of a seated person when the person sits on said seat.

13. The chair of claim 1 further comprising adjustable arm rests.

14. The chair of claim 13 further comprising tiltably adjustable forearm support members.

15. The chair of claim 13 wherein said arm rests are adjustable in a direction toward, and away from, a center of said chair.

16. The chair of claim 13 wherein said arm rests are adjustable in height.

17. The chair of claim 13 further comprising rotatably adjustable forearm support members.

18. The chair of claim 1 further comprising a shroud to hold and conceal adjusting systems.

19. The chair of claim 1 further comprising at least one brace component to independently adjust a length of at least one adjustable support member.

20. The chair of claim 1 further comprising at least one adjusting component to independently adjust at least one brace support member in a direction towards, or away from, said seat.

21. The chair of claim 1 further comprising at least one adjusting component to adjust at least one of said back support members in a vertical direction.

22. An adjustable task chair comprising:

a seat;

at least two back support members;

each said back support member independently supported by a single, tiltable, vertical brace support member, at least one of said back support members being adjustable;

each said brace support member supported by, and pivotally attached to, a frame;

each said brace support member adjustable, independent of each said other brace support member, adjusting a position of said corresponding back support member in an anterior and a posterior direction to vary an angle defined by said back support member with respect to said seat;

at least one holding component mounted on a posterior section of said frame and holding each said brace support member in a position; and at least one adjusting component for overcoming holding of said holding component to adjust at least one of said vertical brace support members, wherein at least one of said adjusting components connects to at least one pneumatic gas cylinder.

23. An adjustable task chair comprising:

a seat;

at least two back support members;

each said back support member independently supported by a single, tiltable, vertical brace support member, at least one of said back support members being adjustable;

at least one adjusting component to independently adjust a length of at least one of said brace support members;

at least one adjusting component to independently adjust at least one of said brace support members in a direction towards, or away from, said seat;

at least one adjusting component to independently control tilt tension of at least one said brace support member;

each said brace support member supported by, and pivotally attached to, a frame; and each said brace support member adjustable, independent of each said other brace support member, adjusting a position of said corresponding back support member in an anterior and a posterior direction to vary an angle defined by said back support member with respect to said seat.

* * * * *